United States Patent [19]

Aaron et al.

[11] 4,124,851

[45] Nov. 7, 1978

[54] UHF ANTENNA WITH AIR DIELECTRIC FEED MEANS

[76] Inventors: Bertram D. Aaron, Engineers Rd., Roslyn Harbor, N.Y. 11576; Edwin B. Pores, 16 Dorchester Dr., Manhasset, N.Y. 11030

[21] Appl. No.: 820,468

[22] Filed: Aug. 1, 1977

[51] Int. Cl.[2] ..... H01Q 1/36

[52] U.S. Cl. ..... 343/772; 343/745

[58] Field of Search ..... 343/789, 772, 746, 745, 343/768, 771, 777, 778, 854, 790

[56] References Cited

U.S. PATENT DOCUMENTS 4,063,248 12/1977 Debski et al. ..... 343/778

*Primary Examiner*—Alfred E. Smith
*Assistant Examiner*—David K. Moore
*Attorney, Agent, or Firm*—Leonard H. King

[57] ABSTRACT

A covert mobile communications omni-directional gain UHF antenna comprises a body having a U-shaped cavity and radiating slot, an L-shaped feed line and an end-loaded, open-circuited voltage probe. The antenna is tuneable by adjusting a pair of variable capacitors to match the impedance of the antenna to that of an attached coaxial cable and transceiver.

8 Claims, 4 Drawing Figures

UHF ANTENNA WITH AIR DIELECTRIC FEED MEANS

BACKGROUND OF THE INVENTION

This invention relates to an improved ridged waveguide antenna.

The two-way radio user in an urban environment is plagued today by the problem of vandalism of car radio antennas and, what is worse, burglary or radio equipment. In most cases, the visibly mounted non-broadcast antenna triggers the pilferage of the radio control head and even the removal of the transceiver from the trunk. Nothing could be more serious for an undercover officer or other two-way radio user than to leave his car and return to find a broken antenna or, worse, that his radio has been stolen.

What the two-way communications community therefore requires is an efficient and easily constructed covert antenna. Varieties of disguised antennas have been used by law-enforcement agencies since the advent of mobile radio. Such antennas have been disguised as AM broadcast antennas mounted on automobile fenders, as side-view mirrors and in other more exotic configurations. Some agencies have cut a large hole into the car's roof or trunk lid to form a half-wave slot antenna, which was then covered with fiberglass and refinished to blend with the rest of the car body. Military studies have been performed on the feasibility of insulating the engine hood or trunk lid from the rest of the body to form a resonant slot antenna.

None of these solutions have proved completely satisfactory. AM broadcast and side-view mirror antennas are still subject to vandalism, and both have very distorted radiation patterns. Side-view mirror antennas have been found to be extremely inefficient. Furthermore, the trunk lid, hood or roof slot antennas are impractical since they are far too expensive to fabricate and can never be transferred from one vehicle to another.

It is, therefore, an object of the present invention to provide an antenna that is completely covert and impossible to detect or vandalize.

It is another object of the present invention to provide such an antenna, the installation of which is quick and easy and can be accomplished without altering a vehicle in which it is to be installed.

A further object and feature of the present invention resides in the novel details of construction which provide a covert antenna that is relatively low in cost and which may be readily manufactured, utilizing well-known techniques.

Other objects and features of the present invention will become apparent from the following detailed description considered in conjunction with the accompanying drawings. It is to be understood, however, that the drawings are designed for the purposes of illustration only and not as a definition of the limits of the invention for which reference should be made to the appending claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
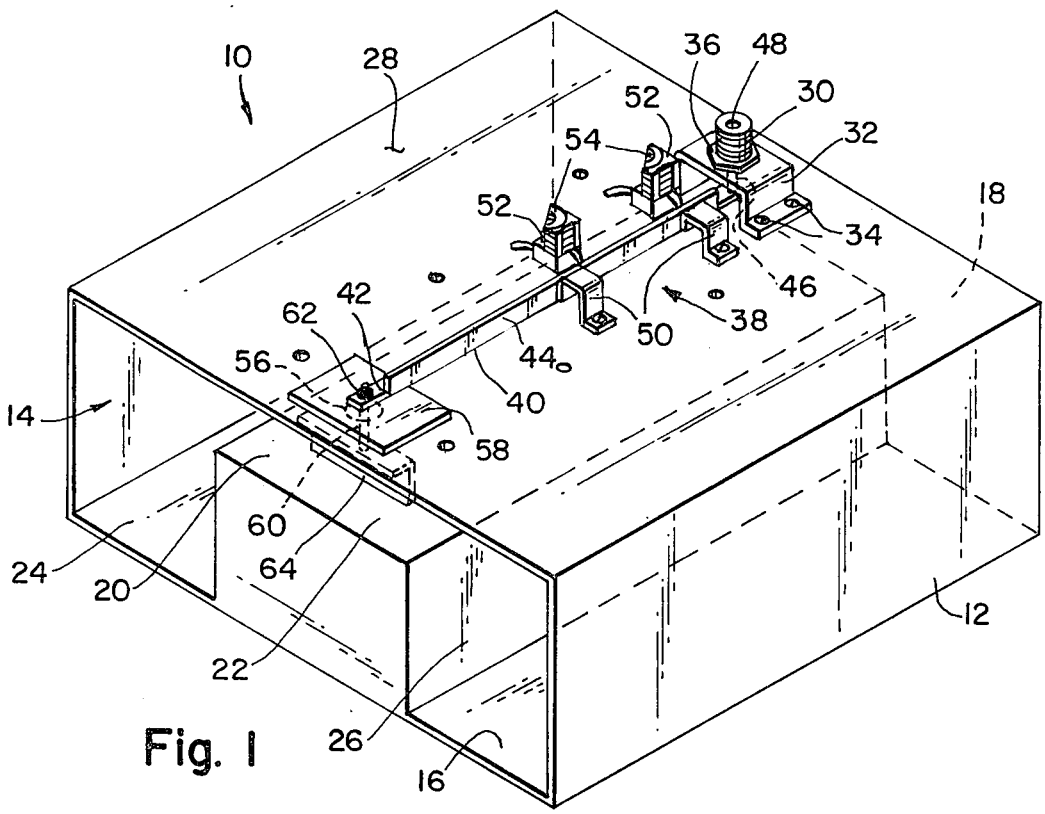
FIG. 1 is a perspective view of the preferred embodiment of the covert antenna of the present invention.
Figure 4:
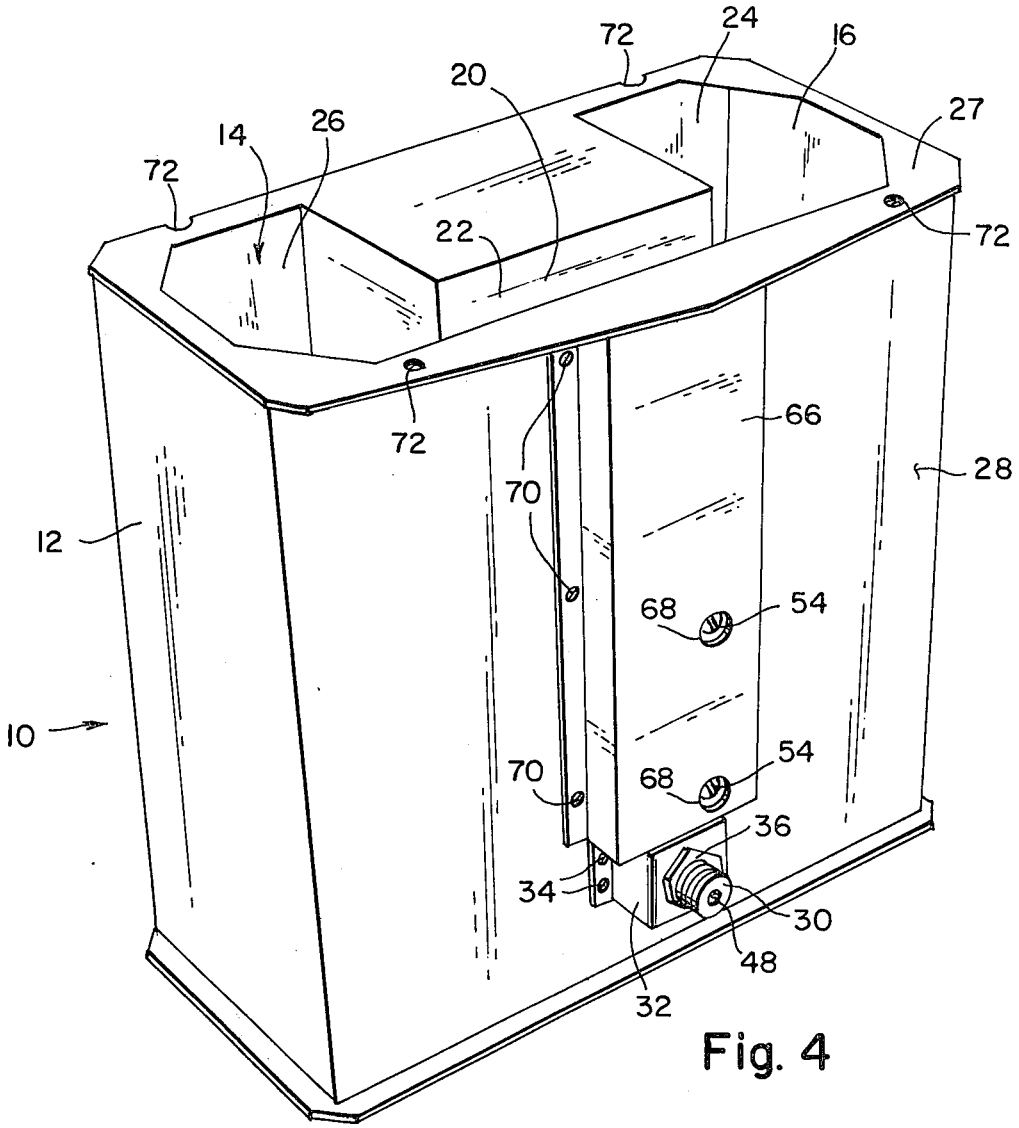
FIG. 4 is a top perspective view of the antenna of the present invention shown in the position in which it may be mounted in a vehicle.

Referring now to the drawing, there is shown in FIG. 1 a covert communications antenna, generally designated by the numeral 10, constructed in accordance with the teaching of the present invention. Specifically, a body 12 of a substantially rectangular configuration is provided with a cavity, designated generally by the numeral 14, having an open forward end or radiating slot 16 and a closed back surface 18. The cavity 14 is further defined by a projecting shelf 20 that serves to configure the cavity 14 as a U-shaped hollow having a mid-section 22 and end-sections 24, 26. The body 12 may be fabricated of sheet metal such as aluminum and may additionally be provided, as shown in FIG. 4, with a mounting plate 27 about the outer periphery of the slot 16 for reasons that will become clear as this description proceeds. The mounting plate 27 may be mounted to the body 12 in any convenient manner, or may be fabricated as a unitary portion thereof.

Figure 2:
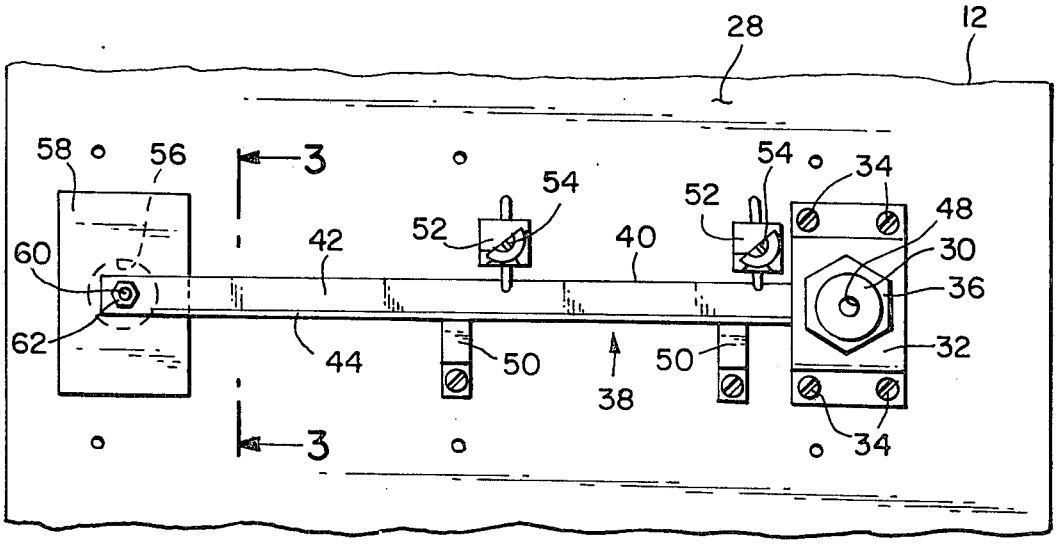
FIG. 2 is a plan view of a portion of the top surface of the antenna shown in FIG. 1.

A top surface 28 on the body 12 has mounted upon it an input connector 30, as shown in FIGS. 1 and 2. The connector 30 is preferably a female connector adapted for connection to a standard coaxial cable. A U-shaped bracket 32 may be affixed to the body surface 28 as by screws 34 or the like for supporting the connector 30. For this purpose, a hole may be provided in the bracket 32 through which the connector 30 may be journaled and secured thereto by means of a nut 36. The bracket 32 may be fabricated of aluminum or a similarly electrically-conductive material to complete a connection from the ground portion of the input connector 30 to the antenna body 12 through the bracket 32.

An air-dielectric feed line, generally designated by the reference numeral 38, is positioned atop the body surface 28, as shown in more detail in FIG. 2, and includes an elongated stripline member 40. The member 40 has an L-shaped cross-sectional configuration, which increases the mechanical rigidity thereof, and is comprised of a first leg 42 positioned substantially parallel to the body surface 28 and a second leg 44 depending on the first leg 42 and positioned substantially normal to the surface 28. It should be noted that the first leg 42 is spaced a selected distance off the surface 28 in a manner that will become clear as this description proceeds. The member 40 is fabricated of an electrically-conductive material such as tin plated brass or the like and it is connected at one end thereof via a conductive strap 46 to the "hot" terminal 48 on the input connector 30. The strap 46 may be an extension of the member 40 and may, by properly selecting the length of the strap 46, act to maintain the member 40, and more particularly the first leg 42, in its spaced relation to the surface 28 by essentially "hanging" the member 40 from the input connector 30.

A pair of shunt inductors 50 are fixed to the member 40 at spaced locations intermediate the ends thereof. Each inductor 50 comprises an elongated electrically-conductive rigid strip bent to a U-shape and soldered at one end of the strip to the second leg 44 of the member 40. The other end of each strip is connected to the body surface 28, as by screws or rivets, to electrically ground the inductor 50 to the antenna body 12. The rigidity of the inductive strips 50 and their connection between the member 40 and the body surface 28 additionally serves to mechanically support the member 40 off the surface 28. The inductors 50 are preferably spaced apart approximately one-eighth (1/8) of the wavelength of the wave to be transmitted from and/or received by the antenna. In addition, the inductors 50 are selectively constructed so that the reactance at the input connector 30 is substantially zero.

A variable capacitor 52 is provided in parallel connection with each of the inductors 50. As shown in FIGS. 1 and 2, each capacitor 52 is positioned on the side of the member 40 opposite that occupied by the inductive strips 50 and directly across the member 40 from its respective parallel inductor. One contact of each capacitor 52 is electrically connected, as by soldering, to the first leg 42 of the member 40 at its respective location, and the other contact is grounded to the body surface 28 by a screw or solder bond. Air-trimmer capacitors, well known in the art, and having screw adjustment means 54 for adjusting the capacitance thereof may be employed for the capacitors 52. It has been found that a capacitance range of 1.5 to 14 picofarads enables the required tuning of the antenna to be easily accomplished.

Figure 3:
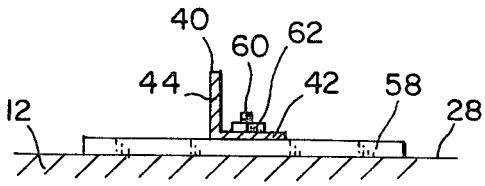
FIG. 3 is an elevational side view taken along the lines 3—3 of FIG. 2.

An opening 56, which may be circularly configured, is defined in the body surface 28 proximate the end of the member 40 opposite its connection to the input connector 30. As detailed in FIG. 3, a dielectric platform 58 is positioned atop the surface 28 directly over the opening 56 in covering relation thereto and acts to support the member 40 at said opposite end in spaced relation to the surface 28. An aperture in the first leg 42 of member 40 is aligned with an aperture in the platform 58 and the opening 56 in the surface 28, which opening 56 is significantly larger than the aligned apertures. These aligned apertures receive therethrough a screw 60 or similarly elongated member having a threaded end for receiving thereon a nut 62. The screw 60 passes through the opening 56 in the surface 28 and into the mid-section 22 of the U-shaped cavity 14 and supports at its lower or head end a voltage probe 64.

The probe 64 is comprised of a generally rectangular metallic member having its lateral face surfaces substantially parallel to the open radiating slot 16. Its lower edge is spaced from the surface of the shelf 20 and, due to the presence of the dielectric platform 58 and the widened opening 56, the probe 64 is electrically insulated from the antenna body 12. Probe 64 is preferably located one-inch into the cavity 14 from the open radiating slot 16.

A U-shaped cover 66, as seen in FIG. 4, may be provided to cover the air-dielectric feed line 38 to protect and electrostatically shield the feed line 38, the capacitors 52, and the inductors 50. Openings 68 positioned over the variable capacitors 52 must be included on the cover 66 to enable access to the screw adjustment means 54. The cover 66 may be secured to the body surface 28 by screws 70 or by any other appropriate means that will permit the removal of the cover.

In operation, the antenna 10 is mounted in, by way of example, an automobile, for covert transmitting and/or receiving. The antenna 10 is positioned, as shown in FIG. 4, with the open radiating slot in an upwardly facing orientation. The mounting plate 27 is provided with mounting holes 72, the positions of which may be selectively located to match the configuration of the standard mounting template for an automobile rear-deck-mounted speaker. This enables the antenna 10 to be secured, as by screws or the like, inside an automobile trunk in the position designed originally for mounting a rear-deck loudspeaker.

A standard transitter and/or receiver is connected to the antenna using a coaxial cable and a standard male mating plug for the input connector 30. Thus, by way of example, a signal from a transmitter is fed by a coaxial cable into the input connector 30. The signal is then fed via the air-dielectric feed line 38 to the voltage probe 64. The impedance of the antenna may be matched to that of the coaxial cable and transmitter by simply adjusting the capacitors 52 at the screw means 54. The end-loaded, open-circuited voltage probe 64 excites the U-shaped cavity 14 and the signal is thereby radiated outwardly from the open slot 16.

One particularly noteworthy feature of the present invention is its use of the metal frame of the autombile rear deck, vehicle roof and trunk lid as the antenna's ground plane. The mid-section of the U-shaped slot 16 radiates upward and backward, generating a forward-travelling, vertically-polarized surface wave on the roof of the car and a rearward-travelling surface wave on the trunk lid thereof. The end-sections of the U-shaped slot 16 support orthogonal electric fields which radiate to the right and the left. These end-sections constitute a two-element antenna array approximately ¼ wave spaced and excited with 180° out-of-phase E-fields. Thus their radiation pattern exhibits nulls forward, rearward and upward and a vertical polarization maxima in the left and right directions.

In all directions between front, rear, left and right both the slot mid-section as well as the slot end-sections contribute to the radiation pattern. Since the phase center of the mid-section and that of the two-element array formed by the two end-sections are both located at the physical center of the open radiating slot 16 and because their relative phase of radiation is 90°, no sharp radiation nulls can occur in any direction. This behavior is analogous to that of the omnidirectional turnstile antenna, constructed of two orthogonal, 90° phased, crossed dipoles.

While there has been shown and described and pointed out the fundamental novel features of the invention as applied to a preferred embodiment thereof, it will be understood that omissions, substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a ridged-waveguide antenna for use with a transmitter to transmit radiowaves at a selected frequency, said antenna having a body, a surface on the body, an input terminal for connection to a coaxial cable and a capacitive tab for exciting the antenna, a tuneable feed-line comprising:

an air-dielectric line between the input terminal and the capacitive tab to feed RF signals therebetween, said line being formed of an electrically-conductive member having an L-shaped cross-sectional configuration to provide mechanical rigidity for said line, two fixed shunt inductors connected between said line and the antenna body, said inductors being so selected to make the input reactance of said line substantially zero, and the distance between said two inductors being related to the frequency of the transmitted wave, and a variable capacitor in parallel with each of said inductors to enable the tuning of the antenna to the coaxial cable and the transmitter.

2. In the antenna of claim 1, said two fixed shunt inductors being separated by approximately one-eighth wavelength of the transmitted wave.

3. In the antenna of claim 1, said variable capacitors being air-trimmer capacitors variable over a range of 1.5 to 14 picofarads.

4. In the antenna of claim 1, said electrically conductive member comprising a relatively flat, planar, elongated member bent substantially parallel to its longitudinal axis to form a pair of depending legs at substantial right angles to one another.

5. In the antenna of claim 4, one of said depending legs being positioned substantially parallel the surface on the antenna body and proximate thereto but spaced therefrom, and the other of said depending legs extending from said first leg substantially normally to and outwardly away from the surface on the antenna body.

6. In the antenna of claim 1, the antenna being operable in the frequency range of 406–512 MegaHertz.

7. In the antenna of claim 1, said inductors also serving as mechanical supports for said member to space the same from the surface on the antenna body.

8. In a ridged-waveguided antenna for use with a transmitter, said antenna having a body, an input terminal for connection to a coaxial cable, a resonant cavity, and a capacitive tab for exciting the cavity, a tuneable feed line comprising:

an air-dielectric stripline connecting the input terminal to the capacitive tab to feed RF signals therebetween, said line comprising a relatively flat, planar, elongated electrically-conductive member longitudinally bent to a cross-sectionally L-shaped configuration having two depending legs at right angles to each other, said member being positioned on the antenna body to position one of said legs parallel to the body and spaced therefrom and the other of said legs projecting from its intersection with the first leg substantially normally outward relative to the antenna body, whereby the L-shaped configuration of said member provides mechanical rigidity for said line, two fixed shunt inductors connected between said member and the antenna body and separated from one another by a distance related to the frequency of the transmitted wave, said inductors being so selected to make the input reactance of said line substantially zero, and a variable capacitor in parallel with each of said inductors to enable the antenna to be tuned to match the impedance of the same to the impedance of the transmitter and the coaxial cable.

* * * * *